US005081399A

United States Patent [19]

Jy

[11] Patent Number: 5,081,399

[45] Date of Patent: Jan. 14, 1992

[54] POWER SUPPLY SYSTEMS FOR NEON LIGHTS

[76] Inventor: Guo J. Jy, No. 51, Min Sheng W. Road, Taipei, Taiwan

[21] Appl. No.: 612,304

[22] Filed: Nov. 13, 1990

[51] Int. Cl.[5] ..... H05B 41/24; H05B 41/44

[52] U.S. Cl. ..... 315/121; 315/127; 315/220; 315/225; 315/323; 315/324; 315/DIG. 7

[58] Field of Search ..... 315/121, 123, 127, 128, 315/209 R, 210, 219, 220, 225, 324, DIG. 7, 323

[56] References Cited

U.S. PATENT DOCUMENTS 4,980,611 12/1990 Orenstein ..... 315/225

*Primary Examiner*—David Mis

*Attorney, Agent, or Firm*—Bucknam and Archer

[57] ABSTRACT

A main power supply device uses single phase, or three phase R, S, T; through rectification and filtration; each phase produces a different D.C. voltage so as to supply a respective voltage transforming device. The rectifier output of a step-down supply of the S, T, phase, in addition to supplying an astable square wave oscillator, so as to control signal outputs via a driving circuit, also supplies a tripping device, so as to control the high A.C. output from the high-voltage transformer of the transforming device. Any abnormal load can be detected by a detecting transformer and a protective circuit, so as to control cut-off of a transistor of a switching loop. A plurality of transforming devices are of the modular plate type; trouble-shooting can be performed easily, and the speed of maintenance is increased; the working safety is also enhanced.

2 Claims, 3 Drawing Sheets

POWER SUPPLY SYSTEMS FOR NEON LIGHTS

FIELD OF THE INVENTION

The present invention relates to power supply transforming systems for electronic neon lights, particularly to voltage transforming devices of the insertable modular plate type, and which share common supply and tripping devices. In addition, trouble-shooting is to be performed easily, and maintenance speed and working safety should be enhanced.

Since conventional neon lights use transformers to obtain a high voltage A.C. supply, and where the required A.C. voltage is obtained in accordance with the length of the neon tube, the transformers used by conventional neon lights are made of silicon steel sheets, in which a conventional supply voltage at an operating frequency of 60 Hz is transformed into a high A.C. output voltage. Therefore for a transformer with an output of 12,000 volts, the windings of the coil will have to include more than 10,000 turns, a fact which will cause it to have a bulky volume, as well as cause it to weigh more than 5 kilograms, thus increasing the working watt hours, as well as causing a great consumption of material. Moreover, when a neon light advertising system is assembled, since the weight and volumes of the individual pieces are considerable, it is very troublesome for workers working on the assembly to carry the pieces or carry out repairs.

Manufacturers in this field have therefore developed a neon light transformer of an electronic type. It mainly includes an A.C. power supply device, a square-wave oscillating device, a control device, a driving device, and a high voltage A.C. output device, so as to transform a low voltage A.C. power supply into a high voltage A.C. power supply, while its volume is ¼ of that of a conventional transformer, and its weight is 0.8 kg, making it convenient for transportation and practical for assembly and repair.

Moreover, as the tendency of modern neon light advertising systems being developed tends toward a large scale, i.e. a transformer for neon lights often contains over one hundred pieces, and as large neon light advertising systems are all located in high buildings, good working safety is required, especially for the maintenance and checking of the system. In view of the fact that neon light transformers are independently packaged in single shells, the neon light transformers are disposed near respective single neon light lamp-tubes (each less than 30 meters). Since the whole system contains over one hundred neon light transformers, the entire arrangement, as well as the circuits become very complicated and cumbersome, a fact which makes the maintenance work extremely difficult; furthermore there is no way to quickly distinguish a neon light transformer individually, thus making trouble-shooting rather difficult.

Furthermore, when a broken neon light transformer is dismantled or replaced, workers still have to untighten and lock fastening elements, such as screws or bolts, and thus are made to consume maintenance working time at a high altitude, which in turn jeopardizes the safety of the workers.

SUMMARY OF THE INVENTION

Due to the shortcomings of current methods of carrying out installation, maintenance, and replacement of parts, the inventor of the present invention has attempted to overcome the drawbacks of the present method, and has effected considerable improvements. After much study, analysis and efforts, the inventor of the present invention has developed an improved power supply system for neon lights.

It is accordingly an object of this invention to provide an electronic power supply transforming system for neon lights, in which all transforming systems are made in the form of insertable modular plates, and where the main power supply and tripping device can be shared, and assembly and disassembly can be performed easily. In actual practice the high voltage A.C. output is produced through the high voltage transformer of the transforming device. Any abnormal load can be sensed by a transformer detecting and protective circuit, and the cut-off of the transistor of the switching circuit can also be controlled; when overall maintenance and inspection are undertaken, any transforming device in trouble can be identified easily.

Therefore the trouble-source can be pinpointed easily; thus maintenance speed and working safety are improved. The technical means adopted for the purpose of achieving the aforesaid objects, and the effectiveness of the present invention will be explained hereinafter by reference to the accompanying drawings.

DESCRIPTION OF THE PREFERRED EMBODIMENT

Figure 1:
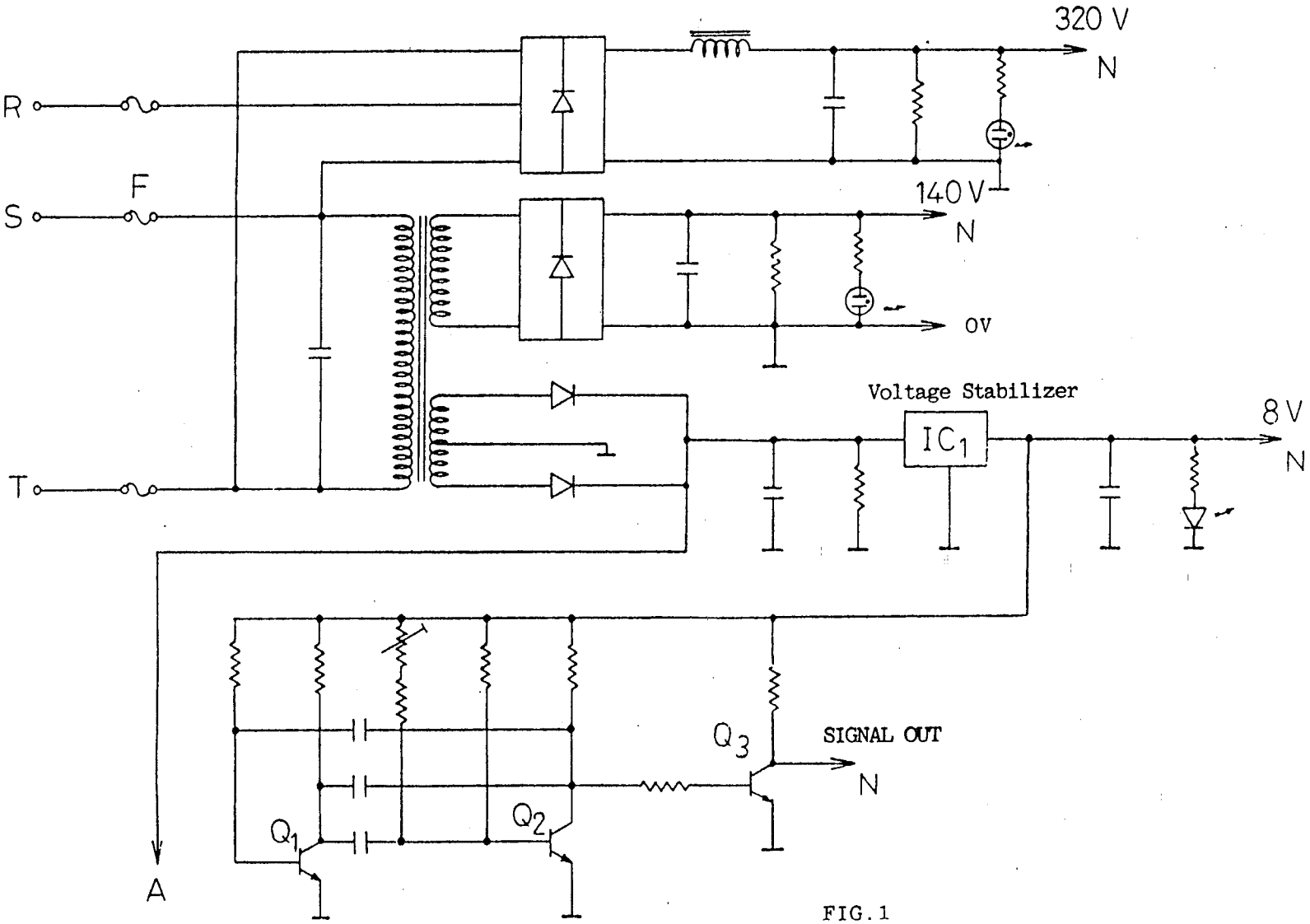
FIG. 1 is the circuit diagram of the main power supply device of a preferred embodiment of the present invention.

Referring now to FIG. 1, which is the circuit diagram of the main power supply device of a preferred embodiment of the present invention, it will be seen that a power supply of three phases R, S, T, is adopted as the main power supply of this embodiment. Various D.C supply voltages, i.e. 320 Volt, 140 Volt, and 8 Volt are obtained at corresponding terminals, after a respective A.C. source is rectified and filtered, and each terminal is connected to a signal lamp to provide an indication of its operation. The D.C. voltages are, in turn, transmitted to transforming devices, where, after being transformed and rectified, the power supply of the S,T, phase is branched off to a tripping device, which will be described in detail later However, the main line is stabilized via a voltage stabilizer IC1, and in addition to providing a current at 8 Volt D.C., it is also branched off to supply an astable oscillating circuit rich in harmonics, wherein a flip-flop is made up of resistors, capacitors and NPN transistors Q1 and Q2; the NPN transistors Q1 and Q2 are used as positive half-wave and negative half-wave switches After being alternatively in an ON and OFF state, high frequency square waves are produced at the collector of the NPN transistor Q2, and are transmitted to the base of NPN transistor Q3 to control the corresponding ON or OFF state thereof, so that signals are produced at the collector of the power supply, so as in turn to supply the driving circuit of the transforming device, to be described in detail later.

Figure 2:
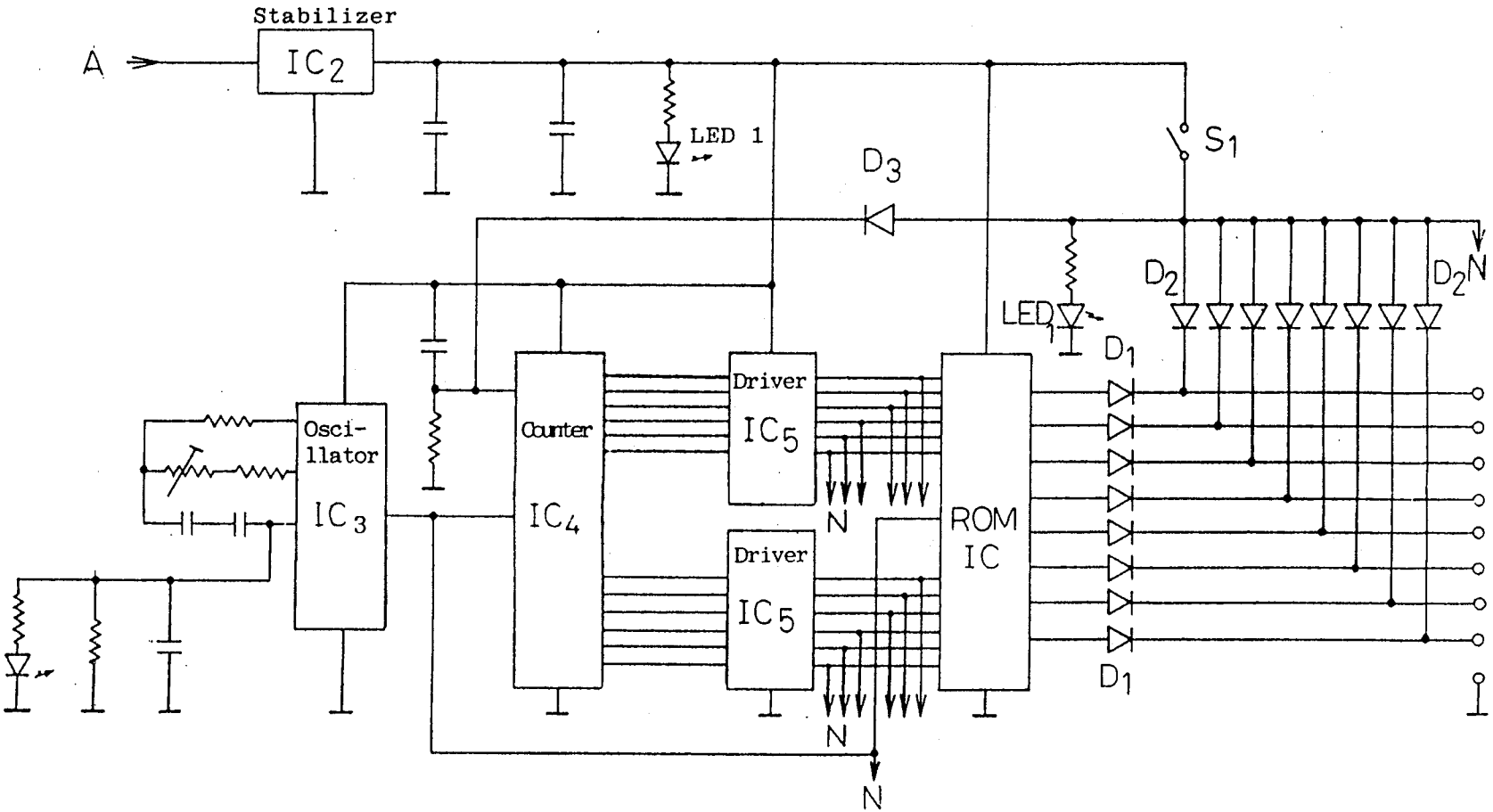
FIG. 2 is the circuit diagram of the tripping device of a preferred embodiment of the present invention, according to FIG. 1.

Referring to FIG. 2, which is the circuit diagram of the tripping device of the invention according to FIG. 1, it will be noted that the power supply of the tripping device supplies power, after the S,T, phase power supply has been transformed and rectified, via a stabilizer IC2 to an oscillator IC3, and then to a counter IC4, drivers or driving devices IC5 and the read-only-memory integrated circuit (ROM IC). However, each output terminal of the the read-only-memory integrated circuit (ROM IC) is connected via a respective diode D1 to supply the control circuit of the transforming device (to be described in detail later); i.e. a single output terminal supplies a corresponding single transforming device. A single ROM IC can control up to eight transforming devices.

A by-pass is provided at the power supply input terminal of the tripping device, which is linked to a function switch S1, which, in turn, is then connected via respective diodes D2 with each signal output of the ROM. When the function switch S1 is ON, all signal output terminals of the ROM have outputs, while when the function switch S1 is OFF, each ROM output is controlled by the ROM IC. The function switch S1 is connected in series with a resistor and an indicating light LED1, and is grounded to indicate operation; it is then connected via a diode D3 to the counter IC4, and a reset loop is thus obtained.

All D.C. supply terminals of 320, 140 and 8 Volt can supply a large number of transforming devices; in FIG. 2 the symbol N represents the number of transforming devices. All output terminals of the driving devices IC5, and of the associated tripping device can also supply a plurality of ROM IC memories. Furthermore the ground lines of the main power supply device, of the tripping device, and of the transforming devices are interconnected, which feature is not specifically shown in the circuit diagrams.

Figure 3:
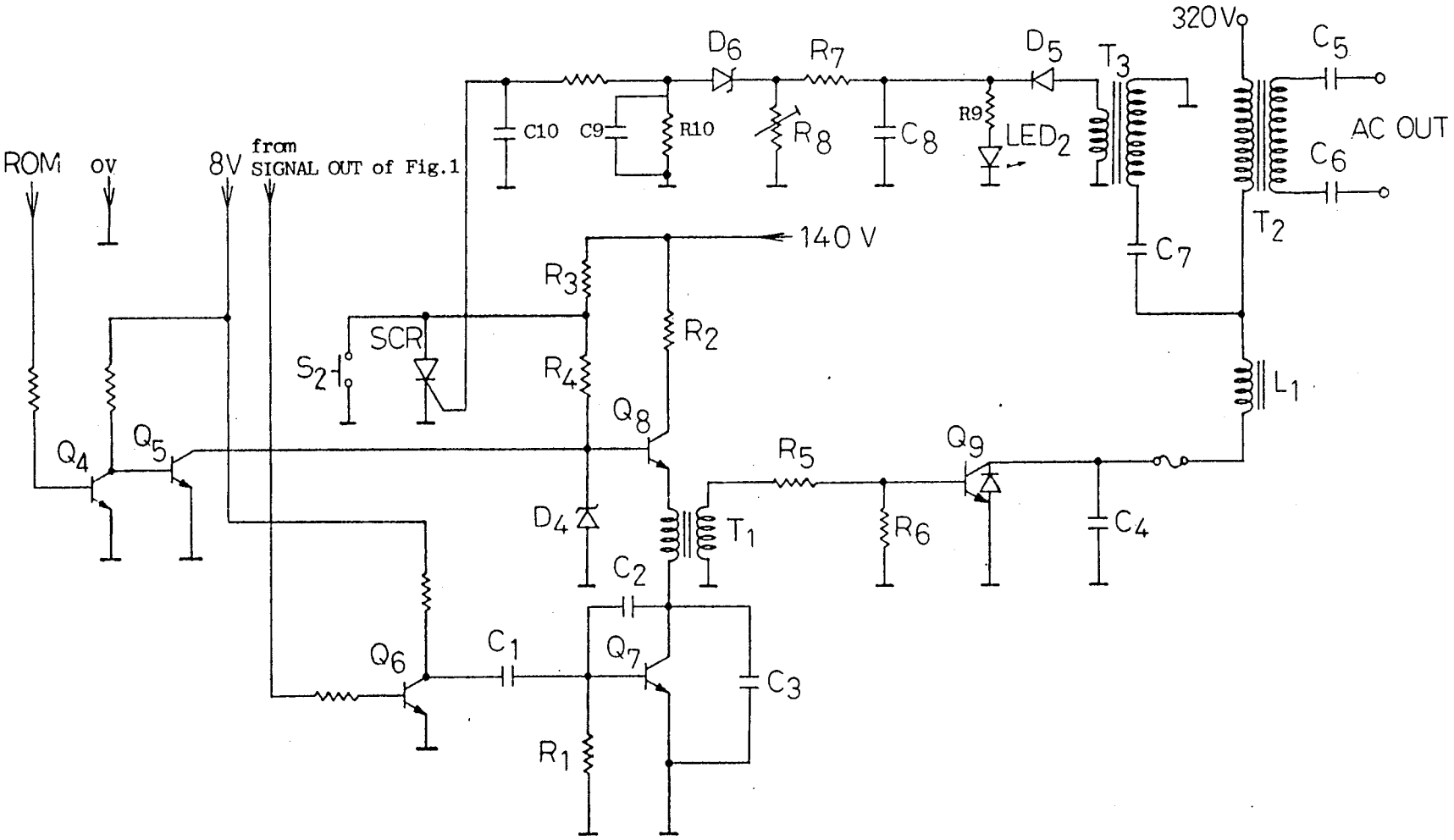
FIG. 3 is the circuit diagram of the transforming device of a preferred embodiment of the present invention, according to FIG. 1.

Please refer now to FIG. 3, which is the circuit diagram of the transforming device. The latter is made up of a control circuit, a driving circuit, a switching loop, a high voltage A.C. output circuit, and a protective circuit. The base of the first transistor Q4 of the control circuit receives the signal of the ROM; the collector of the first transistor Q4 is connected to the base of the second transistor Q5, and is also connected with the 8 Volt D.C. power supply—used as a bias voltage—via a resistor. The conducting or cut-off states of the first transistor Q4, and of the second transistor Q5 are controlled by ON and OFF ROM signals.

First and second driving stages are used by the driving circuit; the base of the first transistor Q6 thereof receives the signal output (SIGNAL OUT) from the main power supply, and its collector is connected to the terminal of the 8 D.C. voltage supply, as well as to the base of the second transistor Q7 via a capacitor C1. A differentiating circuit is made up of the aforementioned capacitor C1 and of the resistor R1, so as to eliminate any D.C. component. Capacitors C2 and C3 are connected, respectively, between the base and the collector, and between the collector and the emitter of the second transistor Q7 to prevent any oscillation. The collector of the second transistor Q7 is connected to the primary coil of a transformer T1, and therethrough to the emitter of an NPN transistor Q8 of the switching loop. The collector of the NPN transistor 08 is connected with the terminal of the 140 Volt D.C. supply, and its base is connected to the collector of the second transistor Q5 of the control circuit, and via voltage-lowering or dividing resistors R3 and R4 to the terminal of the 140 Volt D.C. supply. Its base is stabilized and grounded by means of a Zener diode D4, acting as a stabilizer.

When a signal of the ROM is transmitted to the control circuit, the first transistor 04 conducts (ON), while the second transistor Q5 is cut off (OFF). The second transistor Q7 of the driving circuit conducts through the primary winding of the transformer T1, so that a voltage having an identical phase with that of the primary coil is induced in the secondary coil of the transformer T1.

That voltage passes therefrom via a buffer resistor R5 to a component voltage resistor R6. It is transmitted thereform to the base of NPN transistor Q9 of the high voltage A.C. output circuit, so that the latter is in an ON state. The collector is effectively grounded by a damping capcitor C4, and is connected via a choke L1 to one end of the primary coil of the high voltage transformer T2, so as to serve as an automatic regulator of the load. The 320 Volt D.C. supply is connected to the other end of the primary coil of the transformer T2, so that a voltage of identical frequency is produced at the secondary coil of the transformer T2, so as, in turn, to constitute a high voltage A.C. output. Capacitors C5 and C6 are connected to the respective output terminals of the secondary coil of the transformer T2, so as to constitute a series circuit with the (non-illustrated) neon light tube, so that a harmonic oscilation is generated between the neon light tube and the secondary coil of the transformer T2, so as, in turn, to lower the loading effect thereof, i.e. the loading capacitance of the neon light system, so as to both save electrical energy, and to enhance the brightness of the neon light system.

The primary coil of a sensing transformer of the protective circuit is connected to the high voltage transformer T2 and to a choke coil L1 via a capacitor C7.

The secondary coil of the sensing transformer T3 is, however, connected sequentially to a diode D5, the grounded indicating lamp LED2, the grounded filter capacitor C8, the component voltage resistors R7 and R8, the over-voltage conductive Zener diode D6, and the grounded RC filter circuit, and is thereafter connected to the gate of the silicon control rectifier SCR, which is of the grounded cathode type. The anode of the latter is connected to a point between two voltage-lowering resistors R3 and R4 of the NPN transistor Q8, while the siliconcontrolled rectifier SCR is by-passed to the ground by means of a reset switch S2.

In operation, if an open state occurs, when the neon lamp tube is broken, or any lines break and a voltage drop occurs thereon, then a no-load state exists, and the corresponding detecting transformer T3 reacts immediately so as to drive its associated silicon rectifier SCR into the conducting state, and the bias of the switching loop is grounded, i.e. the NPN transistor 08 is in a cut-off state, so as to prevent the NPN transistor Q9 of the high voltage A.C. output circuit from being overdriven and burned out.

All of the main power supply devices, tripping devices, and transforming devices utilize one housing, while the large number of the transforming devices are of the insertable modular plate type, and also share the main power supply device and the tripping device, from which they can be assembled.

It will be understood that it can also be dismantled therefrom easily. Any malfunctioning transforming device can be identified easily, and trouble-shot, so as to enhance speed of maintenance and safety. In summary, the present invention can achieve a high voltage A.C. output, while maintenance and inspection become simple and rapid, and safety is improved. Furthermore the drawbacks of conventional neon light circuitry are completely eliminated.

I claim:

1. In a power supply transforming system for electronic neon lights, including a main power supply device connected to a single phase or to three phase R,S,T, A.C. power for producing 320 Volt, 140 Volt and 8 Volt D.C. power at respective supply terminals, following rectification and filtering of the voltage component of the A.C. power, a tripping device having an input connected to the 8 Volt D.C. power supply terminal for stabilizing and filtering the power at said input, said tripping device including an oscillator, a counter, an ROM integrated circuit, the latter being supplied by said stabilized and filtered power, and providing control for output signals thereof, a plurality of transforming devices receiving signal inputs from the main power supply device and from the tripping device, each of said transforming devices having at least one of a control- and a driving circuit, said driving circuit including first and second transistors having emitters grounded by one of said control-and said driving-circuits, a high voltage transformer having a secondary coil thereof connected to a collector of said second transistor of said driving circuit, a high-voltage D.C. output circuit including at least one transistor having a base connected to said secondary coil of said high voltage transformer, said secondary coil of said high voltage transformer being connected to said collector of said second transistor of said driving circuit in order to control the high-voltage D.C. output of the high-voltage transformer, the improvement comprising a square-wave oscillator supplying substantially a square wave signal to the base of said first transistor of said driving circuit, so as to control an output signal thereof appearing at its collector, said collector being powered by said 8 Volt D.C. power, said output signal being fed to the base of said second transistor of said driving circuit, said tripping device further comprising a plurality of first diodes fed in parallel by said ROM integrated circuit, and a plurality of second diodes operating at an input of said tripping device and having respective outputs connected in parallel to respective outputs of said first plurality of diodes, by-pass means being provided at said input of said tripping device, a functional switch being connected to said by-pass means, said input of said tripping device being connected to ground through a resistor and indicating lamp means;

said transforming device further including first and second transistors in a control circuit thereof, said first transistor being connected to a base of said second transistor, said base of said second transistor being also supplied by said 8 Volt supply acting as a bias voltage, said output signal from said ROM IC being transmitted to a base of said first transistor, a switching loop including a switching loop transistor, a collector of said second transistor of said control circuit being connected with a base of said switching loop transistor, while an emitter of said switching loop transistor is connected to a primary coil of a transformer of said driving circuit, a collector of said switching loop transistor being connected to said 140 Volt supply terminal via a load resistor, and a base of said switching loop transistor being connected via two voltage-lowering resistors to said 140 Volt supply terminal, said high voltage transformer having a primary coil, a protective circuit including a detecting transformer having primary coil thereof connected to said primary coil of said high voltage transformer via a capacitor, a secondary coil of said detecting transformer together with a diode acting as an indicating lamp, and a resistor in series therewith serving as first and second shunt arms of a first pi-section ladder, a diode serving as a series arm thereof, a second pi-section ladder connected to said first pi-section ladder having a capacitor and a variable resistor as shunt arms thereof, respectively, a fixed resistor serving as a series arm thereof, a third R-section ladder being connected to said second pi-section ladder, and having an overvoltage triggered diode and a fixed resistor as series arm thereof, respectively, another fixed resistor shunted by a capacitor serving as a shunt arm thereof, said third ladder being connected to a gate of a silicon controlled rectifier, a cathode thereof being grounded, an anode thereof being connected to a connection point of said voltage-lowered resistors, another capacitor shunting said latter-named gate, a grounded reset switch shunting said silicon-controlled rectifier.

2. The power supply system according to claim 1, wherein each of said transforming devices is of an insertable plate type, and is easily assembled, and following assembly, is easily disassembled.

* * * * *